US007868828B2

(12) United States Patent
Shi et al.

(10) Patent No.: US 7,868,828 B2
(45) Date of Patent: Jan. 11, 2011

(54) PARTIALLY OVERLAPPED SUB-ARRAY ANTENNA

(75) Inventors: Shawn Shi, Thousand Oaks, CA (US); Stephen W. Alland, Newbury Park, CA (US)

(73) Assignee: Delphi Technologies, Inc., Troy, MI (US)

( * ) Notice: Subject to any disclaimer, the term of this patent is extended or adjusted under 35 U.S.C. 154(b) by 598 days.

(21) Appl. No.: 12/001,293

(22) Filed: Dec. 11, 2007

(65) Prior Publication Data

US 2009/0146904 A1 Jun. 11, 2009

(51) Int. Cl.
*H01Q 21/00* (2006.01)

(52) U.S. Cl. ..... 343/700 MS; 343/893; 343/853

(58) Field of Classification Search ..... 343/893, 343/700 MS, 850, 853
See application file for complete search history.

(56) References Cited

U.S. PATENT DOCUMENTS 3,803,625 A * 4/1974 Nemit ..... 342/368
5,017,931 A * 5/1991 Carlyon ..... 343/700 MS
2007/0279294 A1* 12/2007 York ..... 343/700 MS

* cited by examiner

*Primary Examiner*—Douglas W Owens
*Assistant Examiner*—Dieu Hien T Duong
(74) *Attorney, Agent, or Firm*—Thomas N. Twomey

(57) ABSTRACT

An antenna formed of multiple sub-arrays, each having rows of interconnected radiating elements. One row of radiating elements is shared between two sub-arrays by a coupler which isolatingly couples one row of radiating elements to each of two sub-arrays allowing the feed to the two sub-arrays to be isolatingly applied to the shared row of radiating elements while suppressing grating lobe generation and providing high sub-array isolation.

4 Claims, 5 Drawing Sheets

PARTIALLY OVERLAPPED SUB-ARRAY ANTENNA

BACKGROUND

The present invention relates, in general, to phased array antennas and, in particular, to phased array antennas that require grating lobe suppression.

A phased array antenna is a plurality of sub-array antennas coupled to a common source or load in which the relative phases of the respective signals feeding the antennas are varied in such a way that the effective radiation pattern of the array is reinforced in a desired direction and suppressed in undesired directions.

A limited scan antenna system scans a narrow beam only a few beam widths. Grating lobe suppression is a difficult design task for limited scan antennas where sub-arrays are employed. Few techniques have been developed to reduce the level of spurious grating lobes. One approach is to use non-constant sub-array separations which disrupt the coherent summation of radiation in the grating lobe directions. However, the resulting side lobes are higher.

Another approach is overlapped sub-arrays that interleave the radiation elements. For a fixed sub-array separation, overlapping sub-arrays allow a larger sub-array aperture, resulting in a narrower beam width of the sub-array pattern. The grating lobes of the array can be placed completely within the side lobe region of the sub-array pattern, giving grating lobe suppression. This method works well when the radiation elements are relatively short in the vertical direction according to the orientation shown in FIG. 1

However, for long element arrays, the coupling between elements and, hence, the sub-arrays, due to interleaving, become stronger. The consequence is that the sub-array patterns are degraded resulting in lower gain and higher side lobes, and sub-array port-to-port isolation deteriorates.

It is desirable to provide a novel solution for a partially overlapped sub-array antenna approach, for both short and long element arrays, which provides high isolation between the sub-array ports and desired sub-array patterns can be achieved in a simple and low cost structure.

SUMMARY

An antenna includes a plurality of radiating elements, a first sub-array defined by a plurality of rows of serially interconnected radiating elements, all connected by a first signal feed port, a second sub-array defined by a plurality of rows of serially interconnected radiating elements, all connected by a second signal feed port, a first coupler isolatingly coupling the radiating elements of one row of the first sub-array and the radiating elements of one row of the second sub-array as a shared row of radiating elements, wherein a signal feed through the first and second feed ports is respectively, applied to the shared row of radiating elements of the first and second sub-arrays.

The coupler can include one feed port connectable to the radiating elements in the antenna and first and second isolated ports.

This phased array antenna provides improved sub-array patterns with higher gain and lower side lobes, and increased sub-array port-to-port isolation. This is achieved in a simple, low cost structure and finds particular advantageous use in antennas with long radiating element arrays.

BRIEF DESCRIPTION OF THE DRAWING

The various features, advantages and other uses of the disclosed partially overlapped phased antenna can be had by referring to the following detailed description and drawing in which.

DETAILED DESCRIPTION

Figure 1:
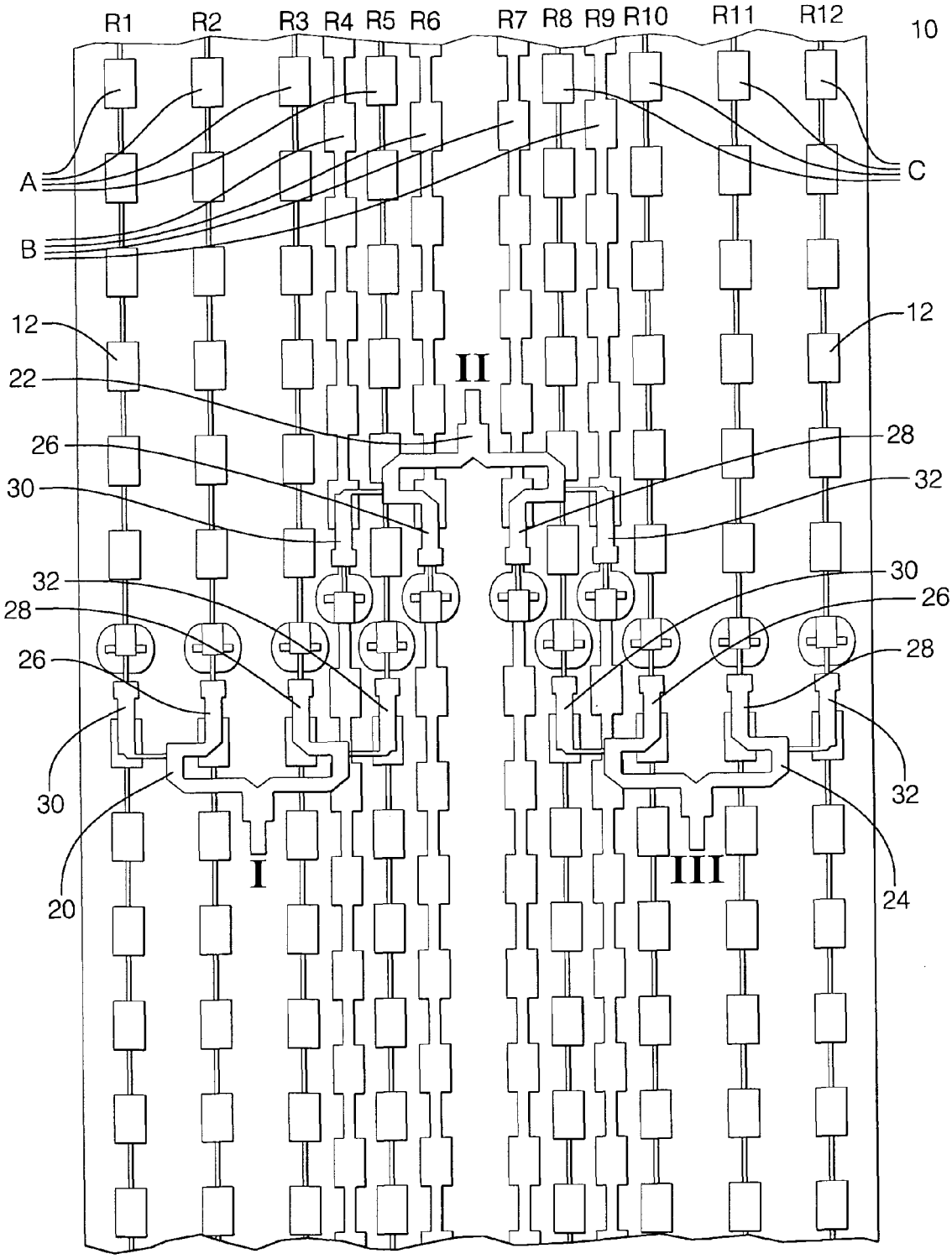
PRIOR ART FIG. 1
FIG. 1 is a pictorial representation of the prior art partially overlapped phased array antenna using interleaving elements.
Figure 2:
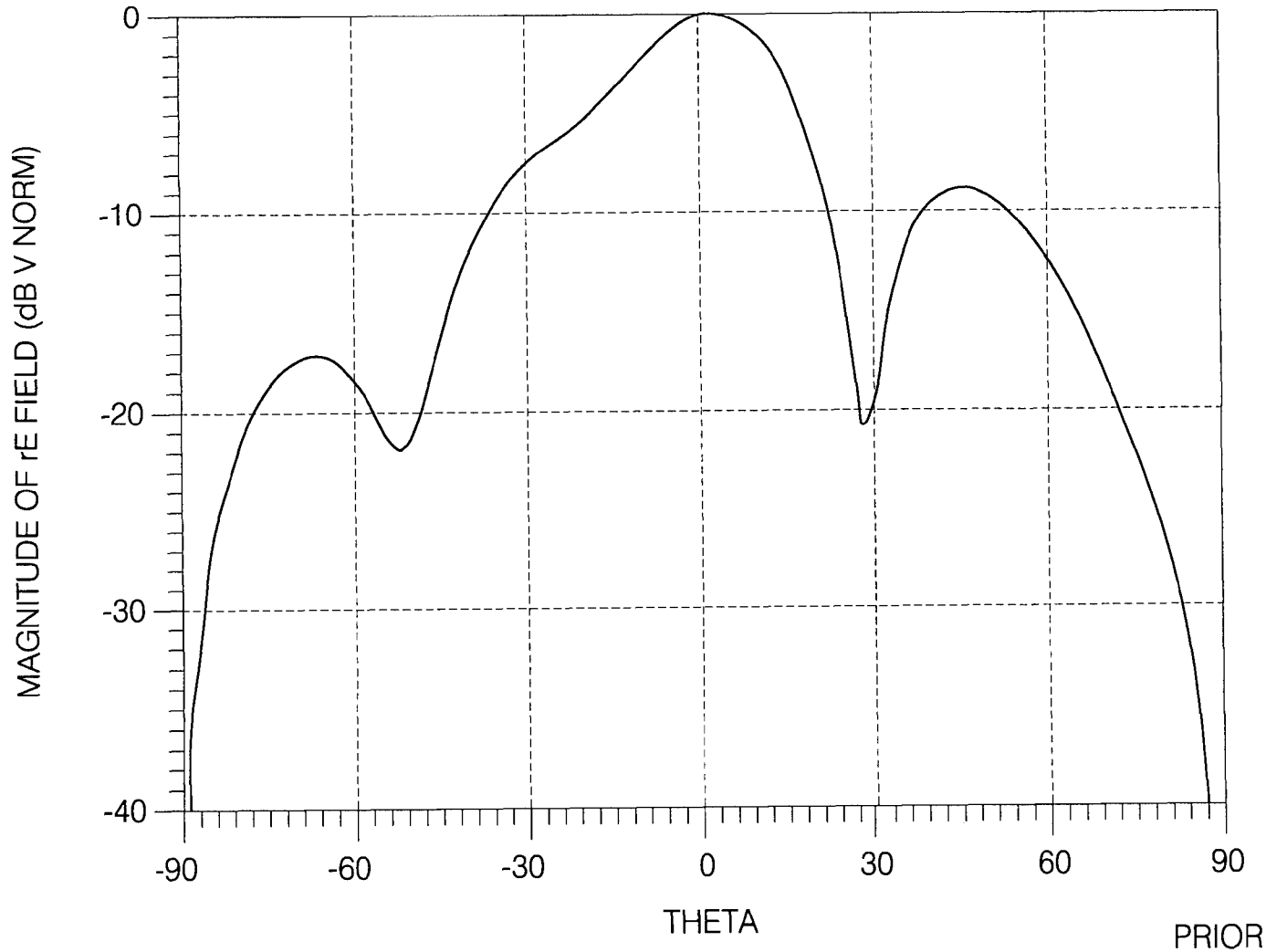
PRIOR ART FIG. 2
FIG. 2 is a graph depicting the sub-array pattern of the prior art antenna shown in FIG. 1.

In order to clarify the understanding the features of the partially overlapped sub-array phased array antenna described hereafter, a brief reference will be had to FIGS. 1 and 2 which depict a prior art partially overlapped sub-array antenna 10 using interleaving elements. For clarity, the antenna 10 is pictorially shown without the substrate, which can be a printed circuit board, or intervening dielectric insulating layers between a radiation layer, a coupling aperture in a middle layer, and a feed network in a bottom layer. The bottom layer is shown overlaying the radiation layer.

The antenna 10 is formed of a plurality of phased sub-arrays A, B and C. Each sub-array A, B and C, is formed of a plurality of rows of serially connected radiation elements 12. The number of radiation elements in each vertical row as well as the number of rows in each sub-array A, B and C can vary according to the particular antenna application. Thus, it will be understood that three sub-arrays A, B and C are shown by example only as the antenna 10 will typically include greater or lesser numbers of sub-arrays.

FIG. 1 depicts a prior art approach to grating lobe suppression in which overlapped sub-arrays interleave the radiation elements. Sub-array A is formed of rows R1, R2, R3 and R5 of serially connected radiation elements 12. Sub-array B is formed of rows R4, R6, R7 and R9 of radiation elements 12. Sub-array C is formed of rows R8, R10, R11 and R12 of radiation elements 12.

Row R4 of sub-array B is interleaved between rows R3 and R5 of sub-array A. Rows R6 and R7 of sub-array B are interleaved between rows R5 and R8 of sub-arrays A and C, respectively. Rows R9 of sub-array B is interleaved between rows R8 and R10 of sub-array C. The radiating elements 12 may be linearly offset as shown in FIG. 1 in separate sub-arrays.

Signal feed ports 20, 22 and 24, each having parallel port connections 26, 28, 30 and 32, respectively, are connected through the coupling apertures to the radiating elements 12 in each sub-array A, B and C to supply feed signals through feed ports I, II and III.

For a fixed sub-array separation, the sub-array overlapping for the antenna 10 shown in FIG. 1 allows a larger sub-array aperture resulting in a narrower beam width of the sub-array pattern. The grating lobes of each array A, B and C can be placed completely within the side lobe region of the sub-array pattern for grating lobe suppression.

This method works adequately when the rows of radiating elements are relatively short in the vertical direction. However, for long element arrays, the coupling between radiating elements 12 and, hence, the sub-arrays A, B and C, due to interleaving become stronger. The consequences are that the sub-array patterns are degraded with lower gain and, higher side lobes, and sub array port-to-port isolation deteriorates. This is evidenced by the graph of the sub-array pattern of the antenna shown in FIG. 2 which shows an undesired pattern shape.

Figure 3:
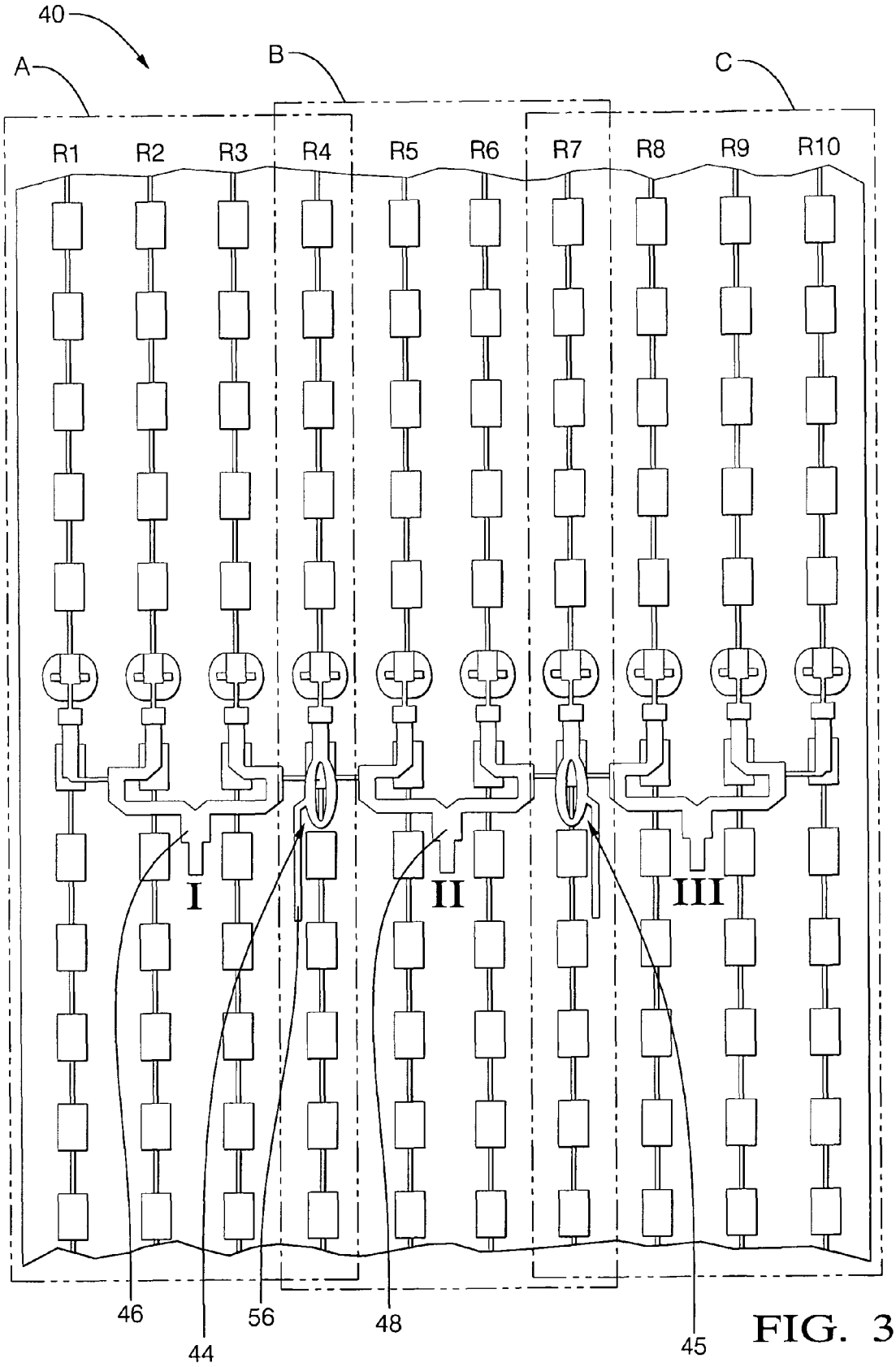
FIG. 3 is a pictorial representation of a partially overlapped phased array antenna using couplers in the feed network.
Figure 4:
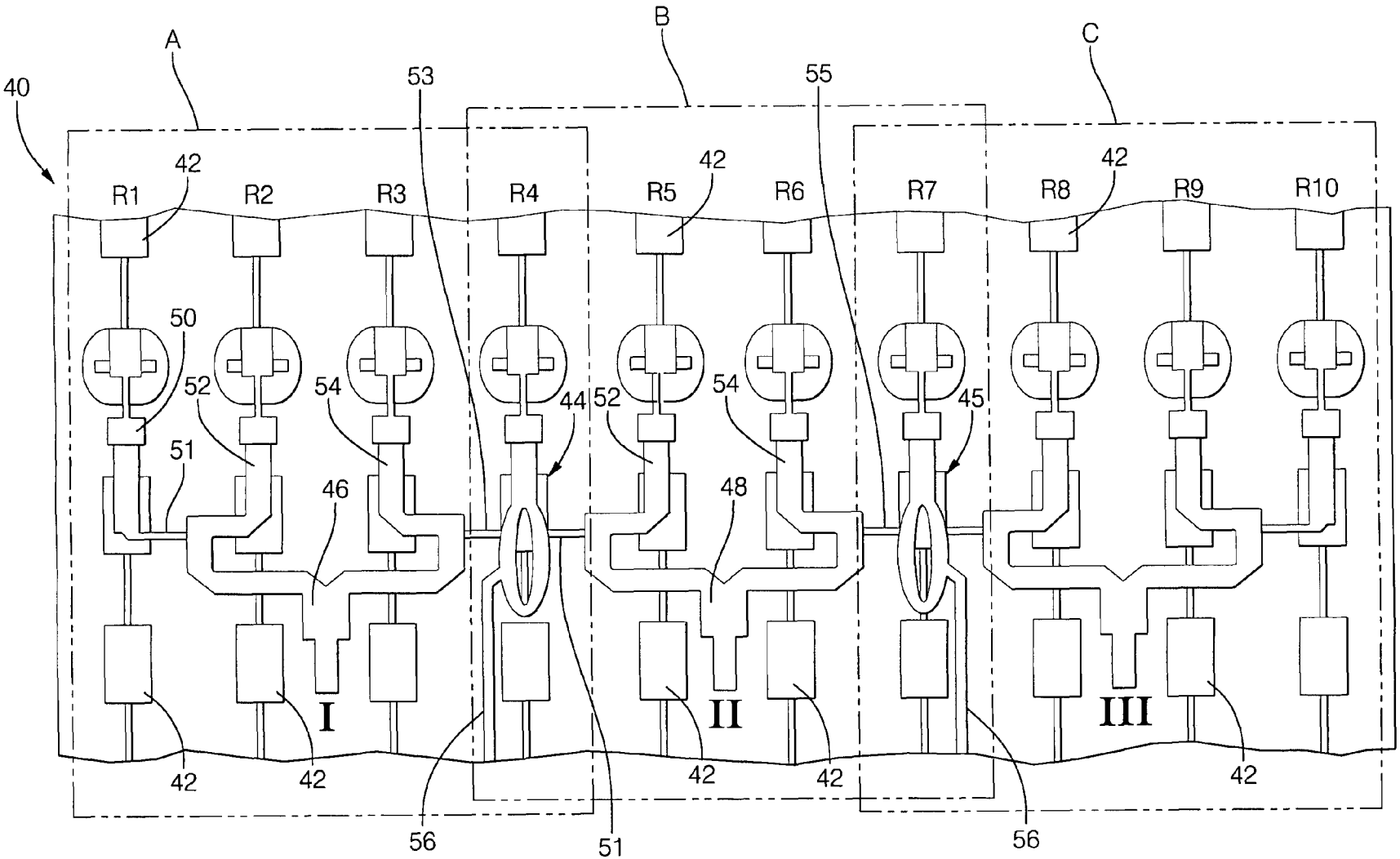
FIG. 4 is an enlarged pictorial representation of the coupler, feed network and radiation elements of the antenna shown in FIG. 3.

Referring now to FIGS. 3 and 4, there is depicted a phased array antenna 40 formed of a plurality of sub-arrays A, B and C. Each sub-array A, B and C is formed of a plurality of rows R1-R10, each row being formed of a plurality of serially interconnected radiating elements 42.

It will be understood that the number of sub-arrays forming the antenna 40 as well as the number of rows in each sub-array and the number of radiating elements in each row can be varied to suit the application requirements of the antenna.

By example only, the sub-arrays A, B and C in the antenna 40 are each formed of four rows of serially interconnected radiating elements 42. The sub-arrays are partially overlapped with one row, such as row R4, being shared by sub-arrays A and B through the use of a unique coupler means 44. The sub-array overlapping is achieved through sharing of the radiating elements 42 in row R4. Since there is no radiating element 42 interleaving, the sub-array to sub-array coupling is very small even for long radiating elements. In addition, since the left and right arms of the coupler 44 are well isolated due to the nature of the coupler 44, the port-to-port isolation between two sub-arrays A, B or B, C is further enhanced.

A similar coupler means 45 may be employed to couple a shared row of radiating elements 42, such as row R7 in sub-arrays B and C, and so on for any additional sub-arrays in the antenna 40.

A signal input through the first sub-array feed port I is fed by the channel 46 of port I to the radiating elements 42 in rows R1, R2, R3 and R4 through two channels 52 and 54 of a power splitter through coupling apertures in the middle layer of the antenna 40 to the radiating elements 42 in the top layer of the antenna 40 stack.

Channels 51 and 53 are connected between the channels 52 and 54, respectively, to a channel 50 connecting the radiating elements 42 in row R1 and to the coupler 44 which provides a connection to the radiating elements 42 in row R4 when an input signal is received through port I of the sub-array A.

Input port II for sub-array B has a similar configuration with a channel 48 split into channels 52 and 54, which are coupled to the radiating elements 42 in rows R5 and R6. Side channels 51 and 55 extend from the port II power splitter 48 to two couplers 44 and 45. Thus, port I feeds the radiating elements 42 in rows R1, R2, R3 and R4. Port II feeds the radiating elements 42 in rows R4, R5, R6 and R7. The first coupler 44 provides feed isolation and sharing between the two sub-arrays A and B in row R4. The second coupler 45 provides feed isolation and sharing between sub-arrays B and C in row R7

The coupler means 44 can be any suitable microwave or radio frequency power splitter-divider or coupler that has two isolated ports and a common feed port. For example only, the coupler means 44 is illustrated in FIGS. 3 and 4 as being a rat-race type coupler. The coupler means 44 can also be any other type of coupler, power divider, combiner or power splitter, such as hybrid branch coupler, a parallel-line coupler, a Wilkinson power divider etc.

The couplers 44 and 45 have a port with an impedance matching tail 56 that has RF absorbing material to be applied thereto.

It will be understood that additional sub-arrays can be added to the antenna 40 with the same radiating element row sharing by the use of additional couplers 44.

The four rows of radiating elements in each sub-array A, B and C can be fed with a desired amplitude taper for low side lobes. The shared rows R4, R7, etc. of radiating elements 42 always have low power amplitude due to the requirement of low side lobes, limiting the power lost to the matched load of the couplers 44.

Figure 5:
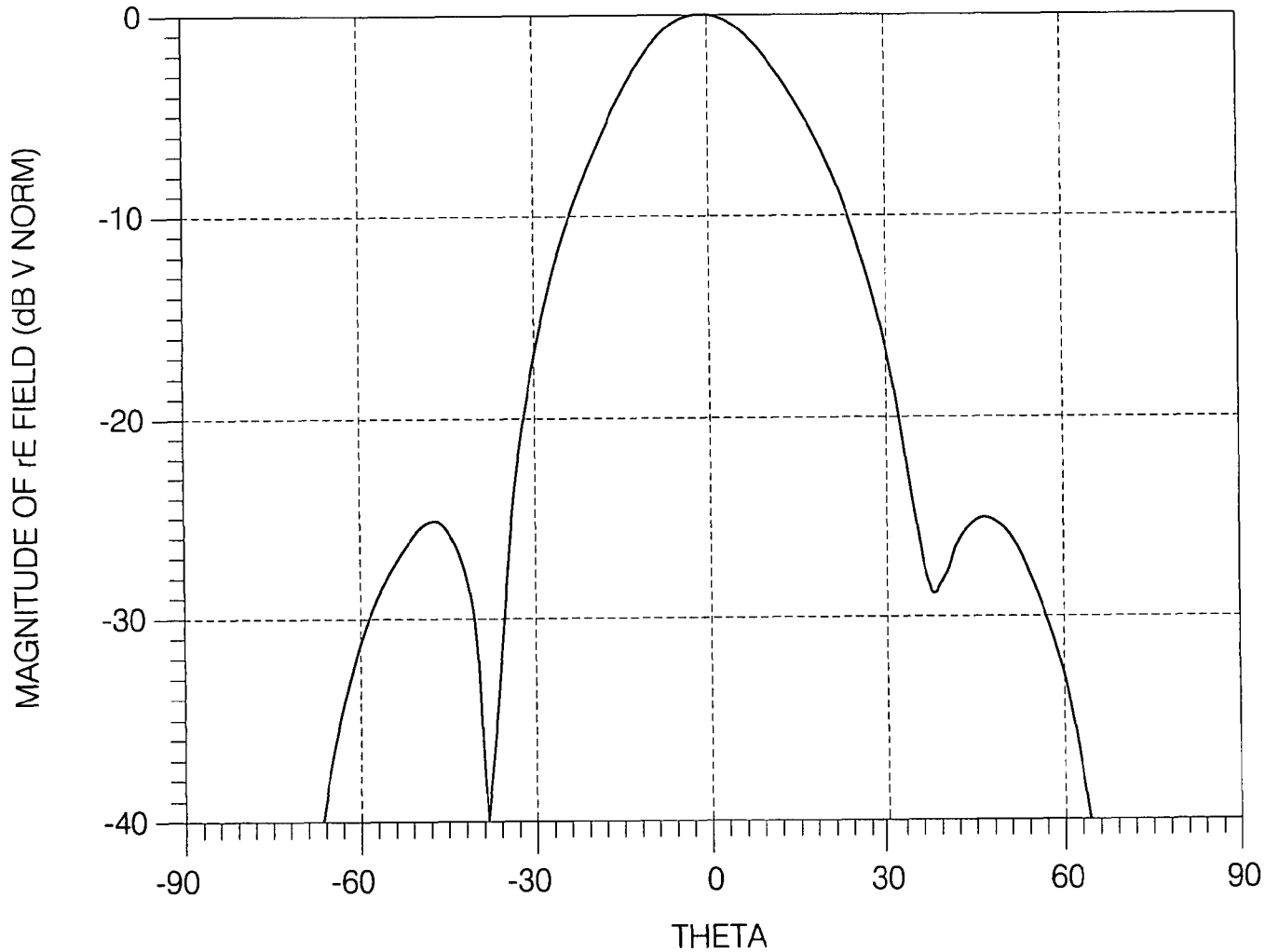
FIG. 5 is a graph depicting the sub-array pattern of the antenna shown in FIGS. 3 and 4.

As depicted in FIG. 5, twenty-five dB sub-array side lobes with the desired pattern shape have been achieved. Such side lobe patterns will effectively suppress grating lobes beyond the sub-array main beam. Measurements indicate that the antenna 40 has more than thirty dB sub-array isolation.

It will be understood that the radiating elements 42 can be any type of radiator, not limited to the illustrated rectangular patch elements.

Further, while the antenna 40 has been described as a phased array antenna, it will be understood that this antenna type is by way of example only as the use of a coupler and a shared row of radiating elements can be used in other types of antennas, such as printed board antennas, etc.

What is claimed is:

1. An antenna comprising a plurality of radiating elements;

a first sub-array defined by a plurality of rows of serially interconnected radiating elements and disposed on a first layer of a substrate, all first sub-array radiating elements connected to a first signal feed port;

a second sub-array defined by a plurality of rows of serially interconnected radiating elements and disposed on a second layer of the substrate, all second sub-array radiating elements connected to a second signal feed port;

the first and second sub-arrays disposed such that each of the radiating elements in one row of the first sub-array is overlapped with each of the radiating elements in one row of the second sub-array to form a shared row; and a coupler connected to the radiating elements of the shared row for providing signals to the radiating elements of the shared row when a signal is applied to either of the feed ports, respectively.

2. The antenna of claim 1, wherein the coupler comprises:

one feed port connectable to the radiating elements in the antenna; and first and second isolated ports.

3. An antenna comprising:

a plurality of radiating elements;

a first sub-array defined by a plurality of rows of serially interconnected radiating elements and disposed on a first layer of a substrate, all first sub-array radiating elements connected to a first signal feed port;

a second sub-array defined by a plurality of rows of serially interconnected radiating elements and disposed on a second layer of the substrate, all second sub-array radiating elements connected to a second signal feed port;

the first and second sub-arrays disposed such that each of the radiating elements in one row of the first sub-array is overlapped with each of the radiating elements in one row of the second sub-array to form a shared row; and a coupler connected to the radiating elements of the shared row for providing signals to the radiating elements of the shared row when a signal is applied to either of the feed ports, the coupler including first and second isolated feed ports respectively connected to the first and second feed signal ports of the first and second sub-arrays.

4. The antenna of claim 3, wherein the coupler further comprises:

a third port coupled to the shared row of radiating elements in the first and second sub-arrays.

* * * * *